US008067882B2

(12) United States Patent
Fukuzawa et al.

(10) Patent No.: US 8,067,882 B2
(45) Date of Patent: Nov. 29, 2011

(54) SEALING MEMBER FOR SPARK PLUG

(75) Inventors: Reimon Fukuzawa, Aichi (JP); Tomoaki Kato, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 650 days.

(21) Appl. No.: 12/245,943

(22) Filed: Oct. 6, 2008

(65) Prior Publication Data

US 2009/0102346 A1 Apr. 23, 2009

(30) Foreign Application Priority Data

Oct. 9, 2007 (JP) ..... 2007-263820

(51) Int. Cl.
*H01T 13/04* (2006.01)
*H01T 13/20* (2006.01)

(52) U.S. Cl. ..... 313/135; 313/118; 313/137; 313/141

(58) Field of Classification Search ..... None
See application file for complete search history.

(56) References Cited

U.S. PATENT DOCUMENTS

| | | | | |
|---|---|---|---|---|
| 2,941,105 | A | 8/1952 | Rickenbach | 313/118 |
| 6,489,709 | B1 | 12/2002 | Teramura et al. | 313/140 |
| 7,977,856 | B2 * | 7/2011 | Hartmann et al. | 313/135 |
| 2004/0066124 | A1 | 4/2004 | Kanao et al. | 313/135 |

FOREIGN PATENT DOCUMENTS

| | | |
|---|---|---|
| JP | 2001187966 | 7/2001 |
| JP | 2004134120 | 4/2004 |

OTHER PUBLICATIONS

*Notice of Allowance* issued in the corresponding Japanese Patent Application No. 2007-263820; dated Dec. 1, 2009, 4 pages.

* cited by examiner

*Primary Examiner* — Natalie Walford
(74) *Attorney, Agent, or Firm* — Kusner & Jaffe

(57) ABSTRACT

A sealing member for a cylindrical spark plug having a metal shell with threaded ridges thereon to be screwed into a mounting hole of a combustion engine, the sealing member comprised of a piece of annular sheet material made of austenitic stainless steel or ferritic stainless steel that is folded back in a radial direction so as to form a region where at least two or more layers of the sheet material are overlapped in an axial direction.

5 Claims, 11 Drawing Sheets

Fe : 2.16mm (1.8L)

SUS : 2.16mm (1.8L)

SUS : 1.74mm (1.45L)

DATA ELEMENT

GREATEST NUMBER OF LAYERS (n) : 4

AVERAGE SHEET THICKNESS (l) : 0.3mm

THREAD RIDGE NOMINAL DIAMETER : M12

◆ SUS

DATA ELEMENT

GREATEST NUMBER OF LAYERS (n) : 4

AVERAGE SHEET THICKNESS (l) : 0.3mm

THREAD RIDGE NOMINAL DIAMETER : M12

× Fe : 2.16mm (1.8L)

◆ SUS

DATA ELEMENT

GREATEST NUMBER OF LAYERS (n) : 4

AVERAGE SHEET THICKNESS (l) : 0.3mm

THREAD RIDGE NOMINAL DIAMETER : M12

TIGHTENING TORQUE : 20N·m

× Fe : 2.16mm (1.8L)

◆ SUS

DATA ELEMENT

GREATEST NUMBER OF LAYERS (n) : 3

AVERAGE SHEET THICKNESS (l) : 0.4mm

THREAD RIDGE NOMINAL DIAMETER : M12

TIGHTENING TORQUE : 20N·m

× Fe : 2.25mm (1.8L)

◆ SUS

DATA ELEMENT

GREATEST NUMBER OF LAYERS (n) : 5

AVERAGE SHEET THICKNESS (l) : 0.25mm

THREAD RIDGE NOMINAL DIAMETER : M12

TIGHTENING TORQUE : 20N·m

× Fe : 2.16mm (1.8L)

◆ SUS

DATA ELEMENT

GREATEST NUMBER OF LAYERS (n) : 4

AVERAGE SHEET THICKNESS (l) : 0.3mm

THREAD RIDGE NOMINAL DIAMETER : M10

TIGHTENING TORQUE : 12.5N·m

× Fe : 2.16mm (1.8L)

◆ SUS

DATA ELEMENT

GREATEST NUMBER OF LAYERS (n) : 3

AVERAGE SHEET THICKNESS (l) : 0.4mm

THREAD RIDGE NOMINAL DIAMETER : M8

TIGHTENING TORQUE : 10N•m

R1=0.1 l mm l

R1=0.2 l mm l

R1=0.4 l mm l

R1=0.8 l mm l

R1=1.0 l mm l

DATA ELEMENT

GREATEST NUMBER OF LAYERS (n) : 4

AVERAGE SHEET THICKNESS (l) : 0.3mm

ENTIRE THICKNESS (l) : 1.6mm

THREAD RIDGE NOMINAL DIAMETER : M8

SEALING MEMBER FOR SPARK PLUG

FIELD OF THE INVENTION

The present invention relates to a spark plug and more particularly to a sealing member that is provided around a metal shell of a spark plug that is to be mounted on a mounting hole of an internal combustion engine to thereby seal air leakage through the mounting hole.

BACKGROUND OF THE INVENTION

A conventional spark plug is mounted on an internal combustion engine by screwing a thread ridge formed on an outer circumference of a metal shell into a female screw formed on a mounting hole of an engine head of the internal combustion engine. Such a spark plug includes an annular sealing member (a gasket) provided on the outer circumference of the metal shell in order to prevent an air leakage from a combustion chamber through the mounting hole. A conventional gasket is formed from an annular shaped cold-rolling strip (hereafter referred to as "Fe"). The annular strip is folded back in the radial direction so as to assume, for example, an "S" shape in the cross section. When screwing the spark plug into the mounting hole, the gasket is sandwiched and compressed between a projecting portion of the metal shell and an opening circumference edge portion of the mounting hole and is deformed to thereby provide a seal therebetween. An axial force (reactive force in the axial direction due to compression caused by tightening the spark plug) acts on the gasket. As a result, the air leakage from the combustion chamber through the mounting hole is sealed.

As internal combustion engines have been miniaturized and advanced in recent years, engine vibration tends to increase, and a temperature in the combustion chamber tends to rise. Because a gasket made of the conventional Fe has relatively low durability over a creep deformation, which is caused by heating and cooling cycles during an engine drive and stop, the spark plug mounted on an engine tends to come loose, resulting in deterioration in the axial force. Therefore, a gasket made of stainless steel, which has a higher rigidity than that of Fe and is unlikely to cause the creep modification, is employed to secure the air tightness of the combustion chamber. (For example, see Japanese Patent Application Laid-Open (kokai) No. 2004-134120).

However, along with the miniaturization of internal combustion engines, spark plugs have also been miniaturized. Since a metal shell of such a sparkplug is formed slimmer and its durability becomes low, a recommended tightening torque when mounting the spark plug is also set to be low. Since a gasket made of stainless steel with a high rigidity is unlikely to plastically deform, sufficient axial force after tightening the spark plug cannot be obtained when the tightening torque is low. As a result, the air tightness in the combustion chamber becomes insufficient. On the other hand, when the tightening torque is raised in order for a gasket to sufficiently deform plastically, stress exerted to a thread neck of a metal shell, which has a low durability due to its miniaturization, increases, resulting in a possible fracture or the like of the spark plug.

The present invention is accomplished in order to solve the above-mentioned problems, and an object of the present invention is to provide a spark plug and a sealing member for the spark plug capable of providing a sufficient axial force with a low tightening torque.

SUMMARY OF THE INVENTION

A sealing member for a spark plug according to a first aspect of the present invention is formed from a piece of annular sheet material made of austenitic stainless steel or ferritic stainless steel and is folded back in a radial direction so as to form a region where at least two or more layers of the sheet material are overlapped in an axial direction. The sealing member is provided around an outer circumference of a metal shell of the cylindrical spark plug that has thread ridges thereon. The sealing member is compressed in the axial direction between an annular-shaped projecting portion disposed on and projecting outwardly from the outer circumference of the metal shell and an opening circumference edge portion of a mounting hole to thereby provide a seal between the projecting portion and the opening circumference edge portion when the metal shell is screwed into the mounting hole of a combustion engine. The sealing member is provided around the metal shell that has a nominal diameter of M12, wherein, before being mounted on the combustion engine, the sealing member satisfies the following relations:

$$0.2 <= l\,[\mathrm{mm}] <= 0.5;$$

$$2 <= n <= 5;\ \text{and}$$

$$1.1\,L <= x <= 1.45\,L \qquad (1),$$

where the number of layers of the sheet material that constitutes the sealing member is expressed by "n" in a region having the greatest number of overlapping layers in the axial direction, where an average thickness of the sheet material is expressed by "l" [mm], where a total thickness of each layer of the sheet material in the region in which the greatest number of overlapping layers is provided is expressed by "L" [mm], and where a thickness of the sealing member in the axial direction before being compressed is expressed by "x" [mm].

A sealing member for a spark plug according to a second aspect is formed from a piece of annular sheet material made of austenitic stainless steel or ferritic stainless steel and is folded back in a radial direction so as to form a region where at least two or more layers of the sheet material are overlapped in an axial direction. The sealing member is provided around an outer circumference of a metal shell of the cylindrical spark plug that has thread ridges thereon. The sealing member is compressed in the axial direction between an annular-shaped projecting portion disposed on and projecting outwardly from the outer circumference of the metal shell and an opening circumference edge portion of a mounting hole to thereby provide a seal between the projecting portion and the opening circumference edge portion when the metal shell is screwed into the mounting hole of a combustion engine. The sealing member is provided around the metal shell having a nominal diameter of M10, wherein, before being mounted on the combustion engine, the sealing member satisfies the following relations:

$$0.2 <= l\,[\mathrm{mm}] <= 0.5;$$

$$2 <= n <= 5;\ \text{and}$$

$$1.1\,L <= x <= 1.4\,L \qquad (2),$$

where a number of layers of the sheet material that constitutes the sealing member is expressed by "n" in a region having the greatest number of overlapping layers in the axial direction, where an average thickness of the sheet material is expressed by "l" [mm], where a total thickness of each layer of the sheet material in the region in which the greatest number of overlapping layers is provided is expressed by "L" [mm], and where a thickness of the sealing member in the axial direction before being compressed is expressed by "x" [mm].

In addition to the first or second aspect, the sealing member for a spark plug according to a third aspect of the present invention, wherein a bent portion serves as a portion connecting a pair of overlapping portions of the sheet material in the axial direction by folding back on itself, wherein, in one of plurality of bent portions, a radius of curvature of a smallest portion is expressed by a minimum radius of curvature "R" in the bent portion, and wherein the sealing member satisfies the following relations:

$$0.2<=R1<=0.8 \quad (3);$$

$$0.05<=R2<=0.2 \quad (4); \text{ and}$$

$$R1>R2 \quad (5),$$

where the minimum radius of curvature "R" of a first bent portion having a largest minimum radius of curvature is expressed by a minimum radius of curvature R1 [mm], and the minimum radius of curvature "R" of a second bent portion having a smallest minimum radius of curvature is expressed by a minimum radius of curvature R2 [mm], when comparing all the minimum radii of curvature "R" of the plurality of bent portions.

In addition to the third aspect, the sealing member for a spark plug according to a fourth aspect of the present invention, the sealing member satisfies the following relation:

$$t2<t1 \quad (6)$$

where a thickness of the sheet material in a region having the minimum radius of curvature R1 of the first bent portion is expressed by t1 [mm], and where a thickness of the sheet material in a region having the minimum radius of curvature R2 of the second bent portion is expressed by t2 [mm].

A spark plug according to a fifth aspect of the present invention, wherein the spark plug is comprised of a sealing member according to any one of above aspects.

Since the sealing member for the spark plugs according to the first aspect is made of austenitic stainless steel or ferritic stainless steel, the sealing member has high rigidity compared to a commonly used sealing member made of a steel strip for cold-rolling, and the sealing member also has high durability over a creep deformation caused by a heating and cooling cycle during an engine drive and stop. When the sealing member is provided on a spark plug having a nominal diameter of M12, it is specified that the entire thickness "x" of the sealing member in the axial direction satisfies the relation of (1). That is, since the thickness "x" in the axial direction is smaller compared to the commonly-used sealing member, the sheet material constituting the sealing member can be joined firmly together under elastic deformation, or can be joined firmly together immediately after reaching the limit of the elastic deformation and starting the plastic deformation. In a relation between the tightening torque of the spark plug and the axial force acting on the sealing member, as the tightening torque increases, the sealing member elastically deforms, and the axial force also rises. When the sealing member reaches the limit of elastic deformation and starts the plastic deformation, the axial force tends to remain unchanged (i.e., an absence of axial force). However, according to the sealing member of the first aspect, the axial force can continue to rise because the sheet materials are attached firmly together under elastic deformation or immediately after starting the plastic deformation.

When the thickness "x" of the sealing member is more than 1.45 L, the axial force over the tightening torque tends to be smaller than that acting on the commonly used sealing member made of a steel strip for cold-rolling. Further, after providing the sealing member around the metal shell, the whole sealing member or a part thereof on an inner hole side is slightly deformed to thereby form an inwardly projecting region for preventing the sealing member from falling off. When the thickness "x" of the sealing member is less than 1.1 L, it is unlikely that the projecting region has a sufficient size for preventing the sealing member from falling off.

Since the sealing member for the spark plugs according to the second aspect is made of austenitic stainless steel or ferritic stainless steel, the sealing member has high rigidity compared to a commonly used sealing member made of a steel strip for cold-rolling, and also has high durability over a creep deformation caused by a heating and cooling cycle during an engine drive and stop. When the sealing member is provided on a spark plug having a nominal diameter of M10 or less, it is specified that the entire thickness "x" of the sealing member in the axial direction satisfy the relation of (2). That is, since the thickness "x" in the axial direction is smaller compared to the commonly used sealing member, the sheet material constituting the sealing member can be attached firmly together under elastic deformation, or immediately after reaching the limit of the elastic deformation and starting the plastic deformation. In a relation between the tightening torque of the spark plug and the axial force acting on the sealing member, as the tightening torque increases, the sealing member elastically deforms, and the axial force also rises. When the sealing member reaches the limit of elastic deformation and starts the plastic deformation, the axial force tends to remain unchanged. However, according to the sealing member of the second aspect, the axial force can continue to rise because the sheet materials are attached firmly together under elastic deformation or immediately after starting the plastic deformation.

When the thickness "x" of the sealing member is more than 1.4 L, the axial force over the tightening torque tends to be smaller than that acting on the commonly used sealing member made of a steel strip for cold-rolling. Further, after providing the sealing member around the metal shell, the whole sealing member or a part thereof on an inner hole side is slightly deformed to thereby form an inwardly projecting region for preventing the sealing member from falling off. When the thickness "x" of the sealing member is less than 1.1 L, it is unlikely that the projecting region has a sufficient size for preventing the sealing member from falling off.

The first bent portion of the sealing member has the largest minimum radius of curvature R1. A magnitude of elastic deformation caused by applying the tightening torque to the sealing member or a magnitude of plastic deformation caused after reaching the limit of the elastic deformation changes depending on the minimum radius of curvature R1. Therefore, there is a correlation between the size of minimum radius of curvature R1 and the axial force. Thus, when a certain compressive force is applied to the sealing member, the magnitude of deformation of the sealing member can be adjusted by varying the size of the minimum radius of curvature R1. Further, the axial force acting on the sealing member can be adjusted by varying the magnitude of deformation of the sealing member. When the spark plug is tightened with a commonly adopted rotation angle (90 degrees-270 degrees) without a torque wrench at the time of mounting, the range of compressive force applied to the sealing member falls within a certain range. Thus, the size of the minimum radius of curvature R1 is adjusted according to the certain range of the compressive force so that a predetermined axial force can be obtained. According to the third aspect, since the minimum radius of curvature R1 satisfies the above-relation of (3), the axial force acting on the sealing member can provide a sufficient sealing effect when the spark plug is mounted with the above-mentioned rotation angle.

According to the third aspect of the present invention, since the minimum radius of curvature R2 of the second bent portion having the smallest minimum radius of curvature R2 that satisfies the above-relation of (4), the elastic deformation and the plastic deformation of the second bent portion are performed smoothly at the time of compression whereby each layer of the sheet material that constitutes the sealing member can be attached firmly together.

Thus, when forming the sealing member made of stainless steel and having high rigidity, it is possible to improve workability of the sealing member if the thickness t2 of the second bent portion that has to be bent greater than the first bent portion is made thinner than the thickness t1 of the first bent portion.

According to the spark plug of the fifth aspect, it is possible to provide a sufficient sealing effect using the sealing member according to any one of the above aspects, even though the spark plug is made smaller in size or slimmer.

DETAILED DESCRIPTION OF PREFERRED EMBODIMENT

Figure 1:
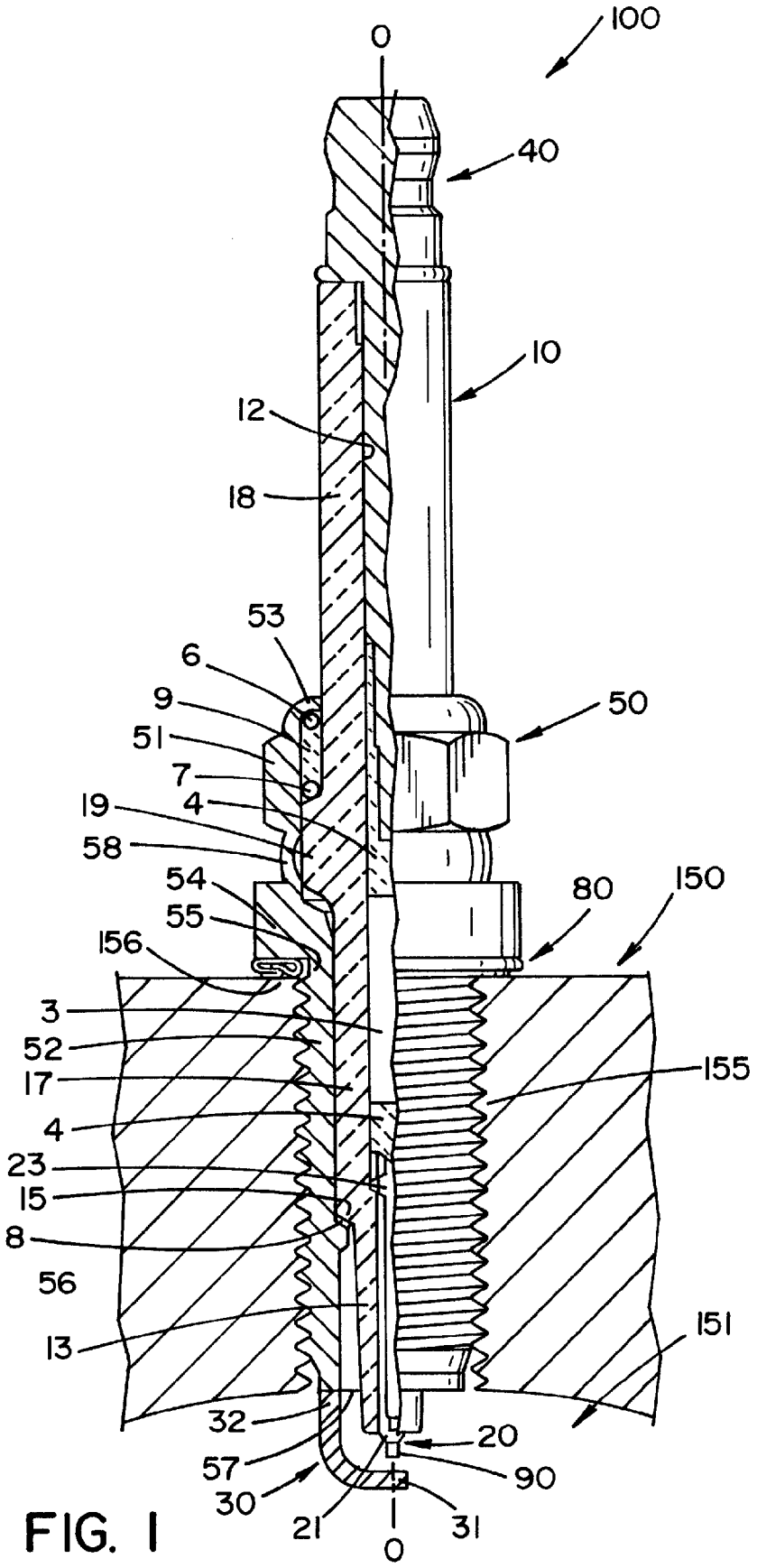
FIG. 1 is a partial sectional view showing a spark plug 100 mounted on an engine head 150.
Figure 2:
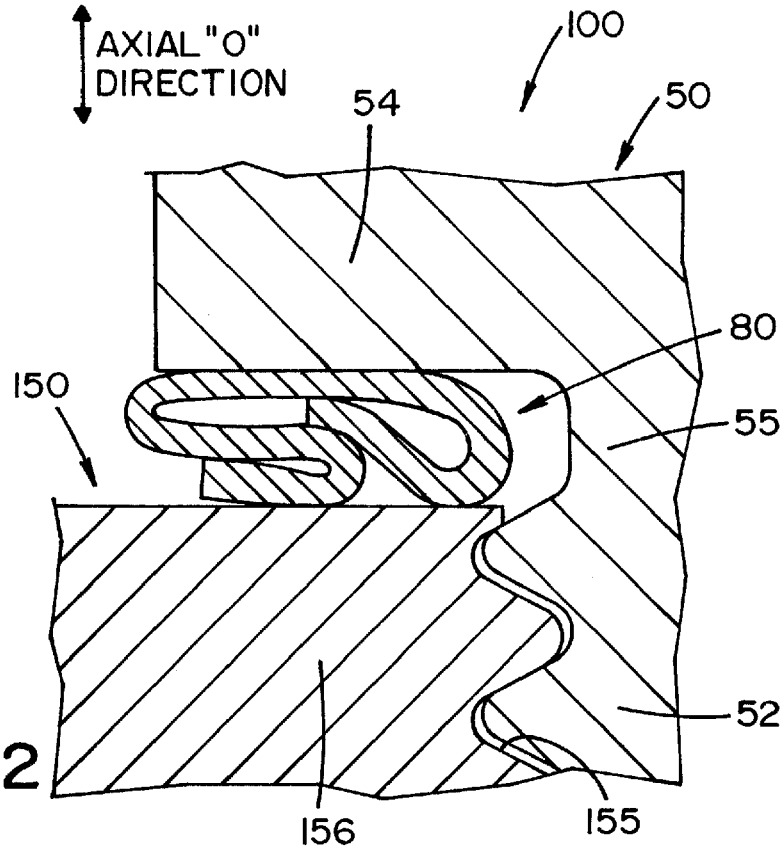
FIG. 2 is an enlarged sectional view showing a gasket 80 of the spark plug 100 mounted on the engine head 150.
Figure 3:
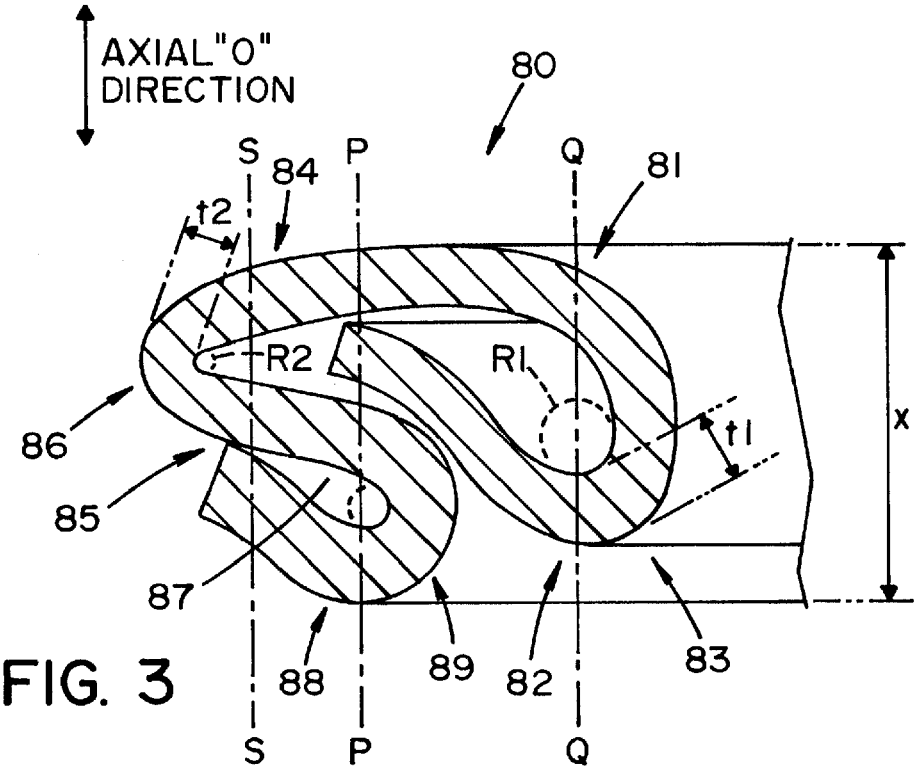
FIG. 3 is a sectional view in a circumferential direction showing the gasket 80 before being deformed under compression.

Hereafter, an embodiment of a spark plug and a method for manufacturing a spark plug which carries out the present invention will be described with reference to the drawings. Referring to *Figs*. 1 to 3, a configuration of a spark plug 100, where a gasket 80 is provided as an example of sealing members according to the present invention, will be described. FIG. 1 is a partial sectional view showing the spark plug 100 mounted on an engine head 150. FIG. 2 is an enlarged sectional view showing a gasket 80 of the spark plug 100 mounted on the engine head 150. FIG. 3 is a sectional view in a circumferential direction showing a gasket 80 before being deformed under compression. In FIG. 1, an axial "O" direction of the spark plug 100 is regarded as the top-to-bottom direction in the drawing. A lower side of the drawing is regarded as a front end side of the spark plug 100 and an upper side of the drawing is regarded as a rear end side of the spark plug 100.

As shown in FIG. 1, the spark plug 100 is comprised of: an insulator 10 having an axial bore 12 therein. A center electrode 20 is disposed in the axial bore 12 at a front end side thereof and a metal terminal fitting 40 is disposed at a rear end side thereof. A metal shell 50 holds and radially surrounds a circumference of the insulator 10 in a circumference direction. Further, a ground electrode 30 is joined to a front end face 57 of the metal shell 50, and a front end portion 31 of the ground electrode 30 is bent so as to face the center electrode 20.

Insulator 10 shall now be described. The cylindrical insulator 10 includes the axial bore 12 extending in an axial "O" direction. Insulator 10 is made of sintering alumina or the like as is commonly known. A flange portion 19 having the largest outer diameter is formed at a generally central area of insulator 10 in the axial "O" direction. A rear end side body portion 18 is formed at the rear end side (upper side in FIG. 1) with respect to the flange portion 19. A front end side body portion 17 having a smaller outer diameter than that of the rear end side body portion 18 is formed at the front end side (lower side in FIG. 1) with respect to the flange portion 19. An elongated leg portion 13 having a smaller outer diameter than that of the front end side body portion 17 is formed at the front end side with respect to the front end side body portion 17. The diameter of the elongated leg portion 13 is gradually tapered off towards the front end side. The elongated leg portion 13 is exposed to a combustion chamber 151 when the spark plug 100 is mounted on the engine head 150. A step portion 15 is formed between the elongated leg portion 13 and the front end side body portion 17.

Next, the center electrode 20 will be described. The center electrode 20 is made of nickel-system alloys or the like, such as INCONEL (trade name) 600 or 601, in which a metal core 23 made of copper or the like with excellent thermal conductivity is provided. A front end portion 21 of the center electrode 20 projects from a front end face of the insulator 10 and is tapered off towards the front end side. A tip 90 made of noble metal is joined to a front end face of the front end portion 21 so as to improve resistance to spark erosion. Further, the center electrode 20 is electrically connected to the metal terminal fitting 40 at the rear end side through a conductive seal material 4 and a ceramic resistance 3 both of which are provided inside the axial bore 12. An ignition coil (not shown) is connected to the metal terminal fitting 40 so as to apply high voltage.

Next, the ground electrode 30 will be described. The ground electrode 30 is comprised of a metal having an excellent corrosion resistance. As one of the examples, a nickel-system alloy, such as INCONEL (trade name) 600 or 601, is used. The ground electrode 30 has a generally rectangular shape as seen from the cross-section in the longitudinal direction. The base end portion 32 of the ground electrode 30 is welded to the front end face 57 of the metal shell 50. The front end, i.e., free end, portion 31 of the ground electrode 30 is bent so that a side face thereof faces the front end portion 21 of the center electrode 20.

Next, the metal shell 50 will be described. The metal shell 50 is a cylindrical metal fitting for fixing the spark plug 100 to the engine head 150 of the internal-combustion engine. The metal shell 50 holds therein the insulator 10 so as to surround a region from a part of the rear end side body portion 18 to the elongated leg portion 13. The metal shell 50 is made of a low carbon steel material and includes a tool engagement portion 51 arranged to engage with a spark plug wrench (not shown) and a fitting thread portion 52 having thread ridges for engagement with a female thread provided on a mounting hole 155 of the engine head 150. It is noted that the metal shell 50 in this embodiment is manufactured according to a standard that specifies a nominal diameter of the thread ridge of the fitting thread portion 52 to be M12.

A flange-like projecting portion 54 is formed between the tool engagement portion 51 and the fitting thread portion 52 of the metal shell 50. A region between the fitting thread portion 52 and the projecting portion 54 is called a thread neck 55 which has an outer diameter smaller than that of the projecting portion 54 and that of the fitting thread portion 52. The gasket 80, which will be described in greater detail below, is provided around the thread neck 55 to thereby seal air leakage from the combustion chamber 151 through the mounting hole 155, when the spark plug 100 is mounted on the engine head 150.

Further, a thin caulking portion 53 is formed at the rear end side with respect to the tool engagement portion 51 of the metal shell 50. Similar to the caulking portion 53, a thin buckling portion 58 is formed between the projecting portion 54 and the tool engagement portion 51. Annular ring members 6, 7 lie between an inner circumferential face of the metal shell 50 and an outer circumferential face of the rear end side body portions 18 of the insulator 10 in the vicinity where the tool engagement portion 51 and the caulking portion 53 are formed. Furthermore, talc powder 9 is disposed between the both ring members 6, 7. The insulator 10 is pressed towards the front end side of the metal shell 50 through the ring members 6, 7 and the talc 9 by inwardly caulking the caulking portion 53. Thus, in the fitting thread portion 52, a step portion 56 of the metal shell 50 projects inwardly and supports the step portion 15 of the insulator 10 through an annular packing 8, thereby integrating the metal shell 50 and the insulator 10. At this time, the air tightness between the metal shell 50 and the insulator 10 is maintained by the packing 8, thereby preventing combustion gas from flowing out. The buckling portion 58 is formed so as to outwardly deform under an application of compressive force at the time of a caulking process. As a result, a compression length of the talc 9 in the axial "O" direction becomes long and the air tightness is securely maintained.

Next, the gasket 80 will be described. The gasket 80, shown in FIGS. 2 and 3, is formed from an annular sheet material made of austenitic stainless steel or ferritic stainless steel is folded back in a radial direction. When the spark plug 100 is mounted on the engine head 150, the gasket 80 is compressed and deformed between an opening circumference edge portion 156 of the mounting hole 155 and the projecting portion 54 of the metal shell 50 to thereby seal air leakage from the combustion chamber 151 through mounting hole 155. FIG. 2 shows a sectional shape of the gasket 80 after being deformed under the compression, and FIG. 3 shows a sectional shape of the gasket 80 before being deformed.

The gasket 80 has a region where at least two or more layers of the sheet material are overlapped in the axial "O" direction. Although not illustrated, the gasket 80 before being compressed has an inner diameter slightly larger than the outer diameter of the fitting thread portion 52. When the gasket 80 is provided on the spark plug 100, the gasket 80 is fitted over the thread neck 55 from the front end side of the metal shell 50. When the gasket 80 is compressed by the projecting portion 54, either the entire gasket 80 or a part of the gasket 80 on the inner hole side is slightly deformed to thereby form a region which projects inwardly with respect to a distal end of the thread ridge of the metal shell 50. Therefore, the gasket is prevented from falling off from the thread neck 55.

In the spark plug 100 according to this embodiment having the above-described configuration, a material of the gasket 80 is specified in order to obtain sufficient axial force to seal air leakage from the combustion chamber 151 even though the tightening torque decreases along with a miniaturization and a reduction in diameter of the spark plug 100. By way of example and not limitation, a stainless steel (SUS) according to the following Japanese Industrial Standards (JIS) number may be employed as a material of the gasket 80. As an example of austenitic stainless steel, it is possible to cite SUS201, SUS202, SUS301, SUS301J, SUS302, SUS302B, SUS304, SUS304L, SUS304N1, SUS304N2, SUS304LN, SUS305, SUS309S, SUS310S, SUS316, SUS316L, SUS316N, SUS316LN, SUS316J1, SUS316J1L, SUS317, SUS317L, SUS317J1, SUS321, SUS347, and SUSXM15J1. As an example of ferritic stainless steel, it is possible to cite SUS405, SUS410L, SUS429, SUS430, SUS430LX, SUS430JIL, SUS434, SUS436L, SUS436JIL, SUS444, SUS445J1, SUS445J2, SUS447J1, and SUSXM27. Compared to a commonly used gasket made of Fe, the gasket 80 made of such a stainless steel has higher rigidity and higher durability over a creep deformation generated by a heating and cooling cycles during the drive and stop of an engine.

When mounting the spark plug 100, the gasket 80 is compressed and deformed between the projecting portion 54 of the metal shell 50 and the opening circumference edge portion 156 of the mounting hole 155 to thereby provide a firmer attachment therebetween and a higher sealing effect. Thus, when using the above-mentioned austenitic stainless steel or ferritic stainless steel, an average thickness of the sheet material that constitutes the gasket 80 is preferably 0.2 to 0.5 mm. When the average thickness of the sheet material is less than 0.2 mm, the gasket 80 is deformed with a relatively small compressive force when mounting the spark plug 100. Thus, it is unlikely to obtain the sufficient axial force with an adequate range of tightening torque. On the other hand, when the average thickness of the sheet material exceeds 0.5 mm, the compressive force for allowing the gasket 80 to deform is necessary to increase. When tightening the sparkplug 100 with an increased compressive force, it is likely to cause damage to the thread neck 55 of the metal shell 50 or cause a deformation of the thread ridge of the fitting thread portion 52. It is noted that the average thickness means an average thickness of the sheet material measured at various points (e.g., 10 different locations) of the sheet material.

A recommended tightening torque when mounting a spark plug on an engine head is defined in JIS B8031 according to the size of spark plug (nominal diameter). The tightening torque decreases as the nominal diameter of the spark plug becomes smaller. In the spark plug 100 having the nominal diameter of not more than M12, when the gasket made of the conventional Fe is replaced by the gasket 80 made of one of the above stainless steel (SUS), the axial force acting on the gasket 80 at the time of tightening is lower than that acting on the gasket made of Fe. This will be described with reference to FIG. 4.

Figure 4:
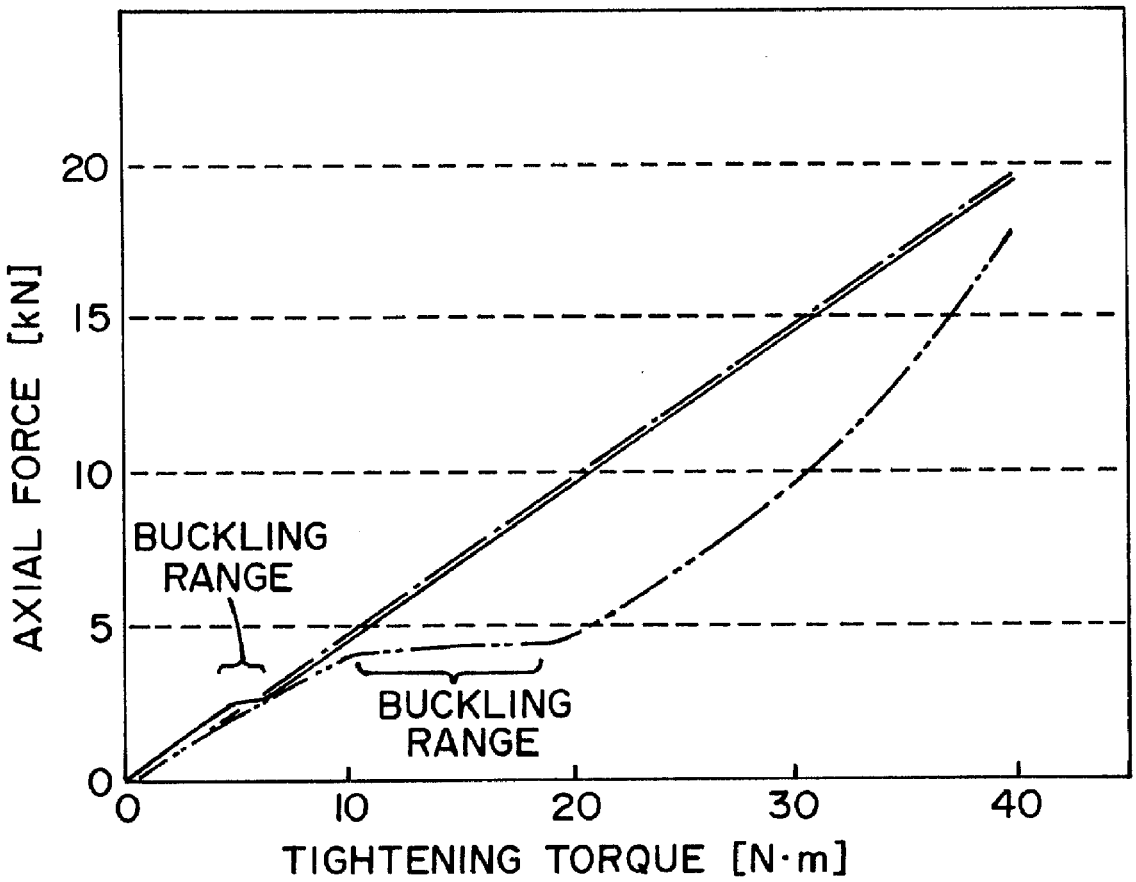
FIG. 4 is a graph showing a relation between tightening torque and axial force.

When the spark plug having the gasket thereon is mounted on an engine head, the gasket causes elastic deformation at an initial stage as the tightening torque increases, and the axial force acting on the gasket rises. As shown in FIG. 4, since the gasket made of stainless steel (shown with a two-dot chain line) has rigidity higher than the gasket made of Fe (shown with a solid line), the tightening torque where the gasket starts plastic deformation (i.e., buckling) after reaching the limit of elastic deformation as the tightening torque increases is greater. Even though the tightening torque rises during an occurrence of the buckling, only the magnitude of plastic deformation of the gasket becomes greater, and the axial force remains unchanged (absence of the axial force). When further increasing the tightening torque, each overlapped-sheet material is attached firmly together in the axial direction and unlikely to cause further plastic deformation. Then, the axial force again starts to rise. Since the gasket made of Fe having lower rigidity than the gasket made of stainless steel tends to cause plastic deformation with relatively low tightening torque, a range of tightening torque while the buckling occurs (hereinafter referred to as a "buckling range") is narrower than that of the gasket made of stainless steel.

In the spark plug having a nominal diameter of M12, the recommended tightening torque is 15-25 N·m (Newton meter) according to JIS B8031. However, in this range, the axial force acting on the gasket made of stainless steel is less than the axial force acting on the gasket made of Fe. That is, the gasket made of stainless steel requires higher tightening torque in order to obtain the axial force equivalent to that acting on the gasket made of Fe.

The gasket 80 according to this embodiment (shown in the one-dot chain line in FIG. 4) is made of stainless steel that has higher durability over the creep deformation and higher rigidity than Fe. Further, by reducing the buckling range, the gasket 80 can obtain the equivalent axial force acting on the gasket made of Fe over the tightening torque. More particularly, the entire thickness of the gasket 80 before being deformed (before tightening) is designed in order to maintain the steady rise in the axial force even though each overlapped sheet material is attached firmly together under the elastic deformation or immediately after starting the plastic deformation as the tightening torque increases.

As shown in FIG. 3, the number of layers of the sheet material that constitutes the gasket 80 is expressed by "n" in a region having the greatest number of overlapping layers in the axial "O" direction (most frequently overlapped region). For example, the gasket 80 in FIG. 3 shows the greatest number of layers of the sheet material that constitutes the gasket 80 on a one-dot line "P" in the axial "O" direction—i.e., the number of layers is four. An average thickness of the sheet material is expressed by "l" [mm], a total thickness of each layer of the sheet material in the most frequently overlapped region is expressed by "L" [mm], and an entire thickness of the gasket 80 in the axial "O" direction is expressed by "x" [mm].

With specifying the entire thickness "x" [mm] of the gasket 80, two virtual planes perpendicular to the axial "O" are assumed. The gasket 80 assumes an annular shape where the circumference thereof extends in a circumference direction. These virtual planes are brought into contact with both sides of the gasket 80 in the axial "O" direction along the entire circumference. In this state, a distance between the virtual planes is deemed to be the entire thickness "x" of the gasket 80.

As described above, an acceptable range of tightening torque at the time of mounting the spark plug is defined according to a nominal diameter of the thread ridge formed on the fitting thread portion 52 of the metal shell 50. As stated in the following, the gasket 80 has a different specification according to the nominal diameter of the thread ridge in order to obtain the sufficient axial force within the acceptable range of the tightening torque.

According to the gasket 80 of this embodiment, when the gasket 80 is provided around the metal shell 50 with the nominal diameter of M12, the gasket 80 satisfies the following relations:

$$0.2<l<=0.5;$$

$$2<=n<=5; \text{ and}$$

$$1.1\ L<=x<=1.45\ L \quad (1).$$

On the other hand, when a gasket is provided around a metal shell with the nominal diameter of M10 or less, the gasket satisfies the following relations:

$$0.2<=l<=0.5;$$

$$2<=n<=5; \text{ and}$$

$$1.1\ L<=x<=1.4\ L \quad (2).$$

As mentioned above, in the manufacturing process of the spark plug 100, the entire gasket 80 or a part of the gasket 80 on the inner hole side is slightly deformed after being provided around the thread neck 55 to thereby form an inwardly projecting portion with respect to the originally-formed inner hole. As a result, the gasket 80 is prevented from falling off from the thread neck 55. With forming the projecting portion, when "x" is less than 1.1 L, a sufficient amount of projection to prevent the gasket 80 from falling off from the thread neck 55 is unlikely to obtain. This is confirmed from the results of a first embodiment, which will be later described.

On the other hand, when "x" is enlarged, the gap between the layers of the sheet material that constitutes the gasket is widened. Since the magnitude of elastic deformation and that of plastic deformation, both of which are required so that the layers are attached firmly together under the compression, become greater, the buckling range shown in FIG. 4 is extended. When the spark plug is mounted on the mounting hole with a recommended tightening torque, "x" is preferably 1.45 L or less when the nominal diameter of the metal shell is M12. Further, when the nominal diameter of the metal shell is M10, "x" is preferably 1.4 L or less. When the entire thickness "x" of the gasket exceeds the upper limit of the above-mentioned value, the axial force acting on the gasket becomes smaller than the axial force acting on the conventional gasket made of Fe that is provided on the spark park plug. This is confirmed from the results of the second to sixth embodiments, which will be mentioned later.

As shown in FIG. 3, in this embodiment, a radius of curvature of each bent portion 83, 86, 89 of the gasket 80 is specified. In the cross section of the gasket in the circumferential direction thereof, the bent portion connects a pair of overlapped regions of the sheet material that constitutes the gasket in the axial "O" direction by folding back on itself. More particularly, the bent portion 83 connects, by folding back on itself, a region 81 and a region 82 of the sheet material both of which are on a one-dot line "Q" extending in the axial "O" direction. The bent portion 86 connects, by folding back on itself, a region 84 and a region 85 of the sheet material both of which are on a one-dot line "S" extending in the axial "O" direction. Further, the bent portion 89 connects, by folding back on itself, a region 87 and a region 88 of the sheet material both of which are on a one-dot line "P" extending in the axial "O" direction.

Next, in each bent portion 83, 86 and 89, in the radius of curvature of the outline on an inner side of the fold-back portion in the circumferential cross section, a radius of curvature of each smallest portion (radii of circles shown with a dot line in FIG. 3) serves as a minimum radius of curvature "R". Further, comparing each minimum radius of curvature "R" of the bent-portion 83, 86 and 89, the minimum radius of curvature "R" of the bent portion 83 serves as a largest minimum radius of curvature R1 [mm], and the minimum radius of curvature "R" of the bent portion 86 serves as a smallest minimum radius of curvature R2 [mm]. At this time, in this embodiment, the following relations are satisfied:

$$0.2<=R1<=0.8; \quad (3)$$

$$0.05<=R2<=0.2; \quad (4) \text{ and}$$

$$R1>R2 \quad (5).$$

It is noted that the bent portion 83 is referred to as a "first bent portion", and the bent portion 86 is referred to as a "second bent portion" in the present invention.

When mounting the spark plug 100 on the mounting hole 155, it is necessary to use a torque wrench in order to tighten the spark plug with the recommended tightening torque. However, when no torque wrench is provided, the required axial force may be obtained by adjusting the rotation angle at the time of tightening. More particularly, the axial force necessary for a situation where the spark plug 100 is tightened with the recommended tightening torque can be obtained by tightening the spark plug 100 with a predetermined rotation angle after the gasket 80 is brought into contact with the opening circumference edge portion 156 of the mounting hole 155. Since the bent portion 83 has the largest minimum radius of curvature R1 (i.e., R1>R2), it greatly influences the magnitude of deformation of the gasket 80 when the gasket 80 is compressed. That is, a state of the elastic deformation of the gasket 80 caused by increasing the tightening torque or a state of the plastic deformation of the gasket 80, caused after reaching the limit of the elastic deformation differs depending on the minimum radius of curvature R1 of the bent portion 83. Therefore, there is a correlation between the rotation angle at the time of tightening and the axial force obtained. Thus, when a certain compressive force is applied to the gasket 80, the magnitude of deformation of the gasket 80 can be adjusted with the size of the minimum radius of curvature R1. Further, the axial force acting on the gasket 80 can be adjusted with the magnitude of deformation of the gasket 80. That is, when the spark plug 100 is tightened with a commonly adopted rotation angle (90 to 270 degrees), compressive force applied to the gasket 80 falls within a certain range, and the size of the minimum radius of curvature R1 can be adjusted according to the certain range of the compressive force in order to obtain a predetermined axial force. Therefore, in this embodiment, the minimum radius of curvature R1 of the bent portion 83 is set to be 0.2 mm or more to 0.8 mm or less. According to the result of the seventh embodiment (will be mentioned later), as long as the minimum radius of curvature R1 of the bent portion 83 falls within the above mentioned range, the axial force of 10 kN (kilo Newtons), which is the minimum force for preventing a loosening of the spark plug due to vibration or the like of an engine, can be obtained when the spark plug is tightened with the commonly adopted rotation angle (90 to 270 degrees).

Unlike the bent portion 83, a bent portion 86 has the smallest minimum radius of curvature R2. Thus, smoothness of the elastic deformation and the plastic deformation of the bent portion 86 affects on adhesion when each layer of the sheet material that constitutes the gasket is attached firmly together. In this embodiment, the minimum radius of curvature R2 of the bent portion 86 is set to be 0.05 mm or more to 0.2 mm or less. When the minimum radius of curvature R2 of the bent portion 86 is less than 0.05 mm, a crack is likely to occur at the time of compressing the gasket 80. Further, the minimum radius of curvature R2 of the bent portion 86 is larger than 0.2 mm, each sheet material is insufficiently attached together under compression of the gasket 80, and it is found that loosening of the spark plug is likely to occur due to the vibration or the like of the engine, according to the result of an eighth embodiment (will be mentioned later).

In this embodiment, the following relation is satisfied:

$$t2<t1 \quad (6)$$

where, in the bent portion 83, a thickness of the sheet material in a portion where a radius of curvature serving as the minimum radius of curvature R1 is set to be "t1" [mm], and where, in the bent portion 86, a thickness of the sheet material in a portion where a radius of curvature serving as the minimum radius of curvature R2 is set to be "t2" [mm].

As mentioned above, the bent portion 86 having the minimum radius of curvature R2 smaller than the minimum radius of curvature R1 of the bent portion 83 is necessarily bent greater than the bent portion 83 during the manufacturing. When considering a workability of the gasket 80 made of stainless steel, the thickness t2 of the larger bent portion 86 is preferably made thinner than the thickness t1 of the bent portion 83.

Thus, when a gasket 80 made of stainless steel that has a higher rigidity than that of a conventional gasket made of Fe is used for the spark plug 100, the size of the gasket 80 is defined by conducting various evaluations in order to obtain the sealing effect similar to that obtained from the gasket made of Fe.

First Embodiment

First, an evaluation test for determining a lower limit of the entire thickness "x" of the gasket was conducted. In this test, a sheet of stainless steel was formed into an annular shape with the average thickness "l" of 0.3 mm, and a plurality of thus-formed sheet materials was prepared. As shown in FIG. 3, each sheet material was subjected to a bending process using a mold so that the number of layers "n" of the sheet material was 4 in a region having the greatest number of overlapping layers in the axial "O" direction. At this time, the mold was adjusted so that each entire thickness "x" of the gasket after the bending process was made to fall within the range from 1.0 L to 1.65 L. Fifty samples of each thickness "x" for M12 were produced.

The thus-formed samples were provided on spark plugs for the test. In order to prevent the gasket from falling off, an inwardly projecting region was formed where a part of the gasket on the inner hole side was slightly deformed. Then, each spark plug having the gasket sample was caused to vibrate, and the number of times that the gasket was fallen off was counted. The result of the test is shown with a graph in FIG. 5.

Figure 5:
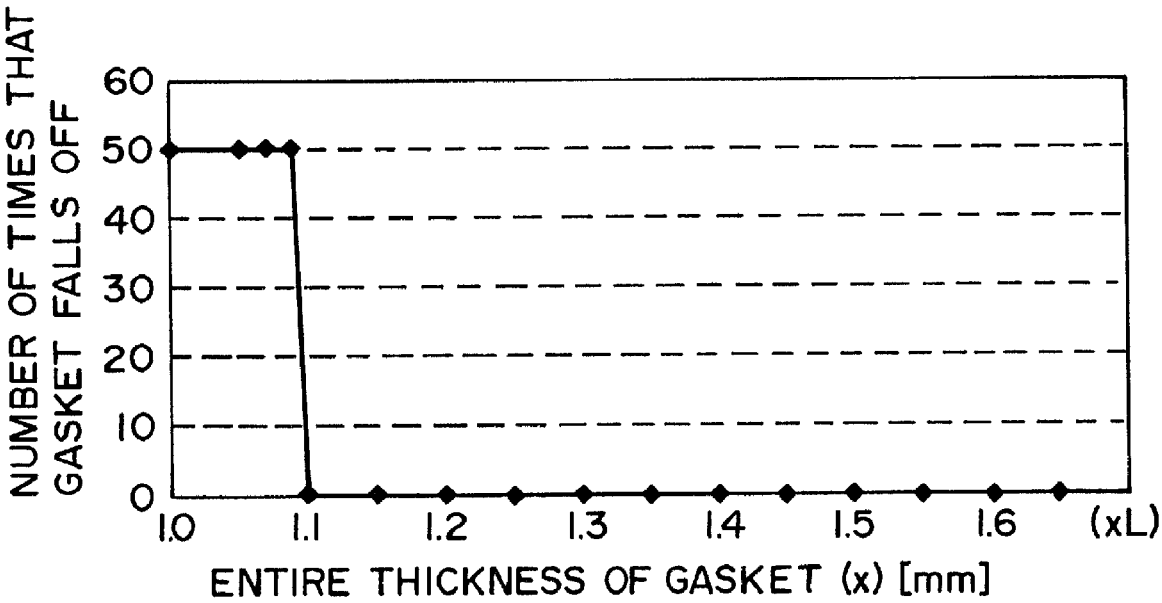
FIG. 5 is a graph showing a relation between an entire thickness of the gasket and the number of times that the gasket is fallen off.

As shown in FIG. 5, in the samples having the thickness "x" of 1.1 L or more, there was no fallen gasket in a vibration test. However, in the samples having the thickness "x" of less than 1.1 L, all the gaskets fell off. Thus, in order for the projecting region to have a sufficient size for preventing the gasket from falling off, it was confirmed that the entire thickness "x" should be 1.1 L or more.

Second Embodiment

Next, the evaluation test for confirming an upper limit of the entire thickness "x" of the gasket was conducted. Similar to the first embodiment, in this embodiment, a plurality of sheet materials constituting the gasket and made of stainless steel (SUS) with the average thickness "l" of 0.3 mm was prepared. Then, the sheet materials were subjected to bending process so that the number of layers "n" of the sheet material was "4" in the region having the greatest number of overlapping layers in the axial "O" direction. The entire thickness "x" of the gasket after the bending process was made to fall within the range from 1.0 L to 1.85 L. A plurality of gasket samples for M12 was prepared. Further, for comparison, gasket samples having the same shape as that of the above samples and an entire thickness of 1.8 L (2.16 mm) were produced using a sheet material made of Fe with the average thickness of 0.3 mm.

Thus-produced samples were provided on spark plugs for the test, respectively, and these spark plugs were mounted on an aluminum bushing made of the same material as an engine head with the tightening torque of 20N·m. Then, the axial force acting on the gasket was measured. In the aluminum bushing, a female screw engaging with the spark plug that has a nominal diameter of M12 according to JIS B8031 is formed on a mounting hole of a bar material with a numerical control machining. Further, the axial force is measured by electrically detecting the compressive force after tightening the spark plug using a load cell sandwiched between an opening circumference edge portion of the aluminum bushing and the gasket. The results of the test were shown with a graph in FIG. 6.

Figure 6:
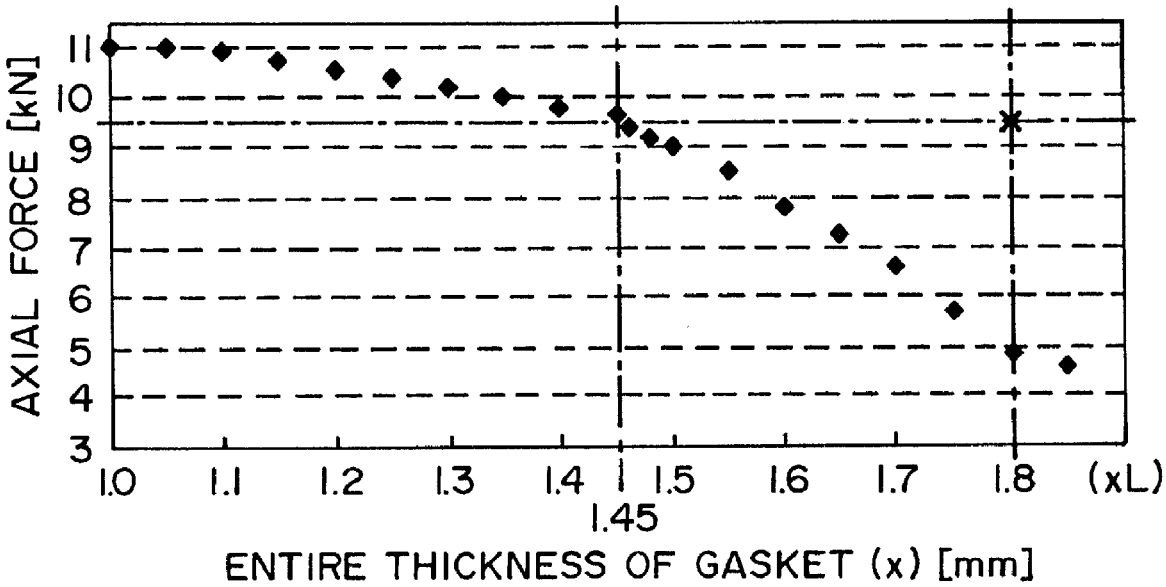
FIG. 6 is a graph showing a relation between the entire thickness of the gasket and axial force.

As mentioned above, the gasket made of stainless steel has high tolerance over plastic deformation compared to the gasket made of Fe, and the axial force generated with the tightening torque of 20 N·m was small (refer to FIG. 4). As shown in FIG. 6, as the entire thickness "x" of the gasket increased, the axial force acting on the gasket was small. In the Fe-made gasket (the entire thickness is 1.8 L) with the conventional size (shape), the axial force of about 9.5 kN was obtained in the tightening torque of 20 N·m. On the other hand, in the gasket made of stainless steel, the axial force of only about 4.8 kN was obtained. In order for the gasket made stainless steel to obtain the axial force equivalent to that acting on the conventional gasket made of Fe, it was determined that the entire thickness "x" should be 1.45 L or less.

Third Embodiment

Figure 7:
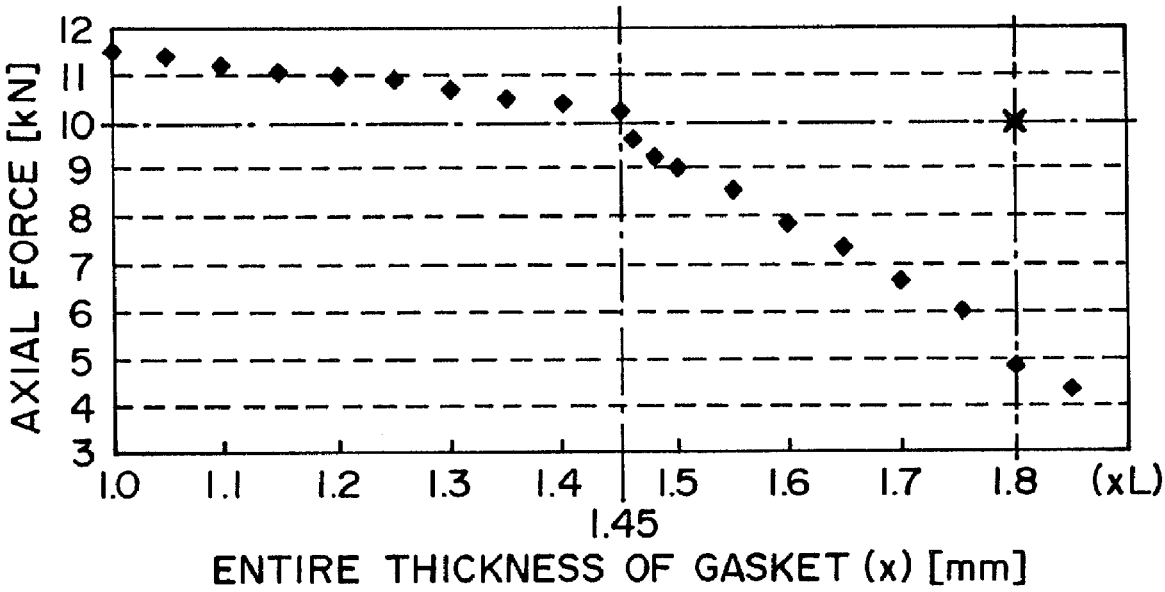
FIG. 7 is a graph showing a relation between the entire thickness of the gasket and axial force.

Next, similar to the second embodiment, an evaluation test was conducted on a gasket for a spark plug that has a nominal diameter of M12. Similar to the above, in this evaluation test, a plurality of gasket samples made of stainless steel and satisfying the following conditions was prepared for an M12 spark plug. The average thickness "l" of the sheet material constituting the gasket was 0.4 mm, and the number of layers "n" of the sheet material was 3 in the region having the greatest number of overlapping layers in the axial "O" direction. The entire thickness "x" of the gasket after the bending process was made to fall within the range from 1.0 L to 1.85 L. Further, for comparison, gasket samples having the same shape as that of the above samples and an entire thickness of 1.85 L (2.16 mm) were produced using a sheet material made of Fe with the average thickness of 0.4 mm. When the evaluation test was conducted by the same method as the second embodiment, as shown in FIG. 7, it was confirmed that the gasket having the greatest number of overlapping layers of 3 exhibited the same tendency as that having overlapping layers of 4, which was evaluated in the second embodiment. In order for the gasket made stainless steel to obtain the axial force equivalent to that acting on the conventional gasket made of Fe, it was determined that the entire thickness "x" should be 1.45 L or less.

Fourth Embodiment

Figure 8:
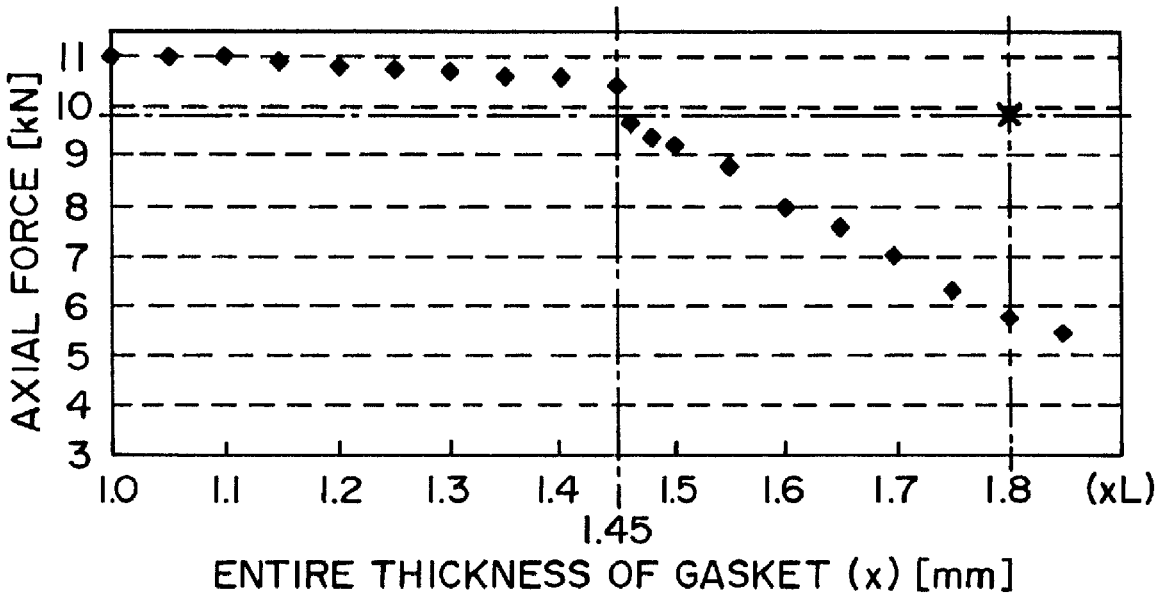
FIG. 8 is a graph showing a relation between the entire thickness of the gasket and axial force.

Further, similar to the second embodiment, an evaluation test was conducted on a gasket for a spark plug that has a nominal diameter of M12. Similar to the above, in this evaluation test, a plurality of gasket samples made of stainless steel and satisfying the following conditions was prepared for an M12 spark plug. The average thickness "l" of the sheet material constituting the gasket was 0.25 mm, and the number of layers "n" of the sheet material was 5 in the region having the greatest number of overlapping layers in the axial "O" direction. The entire thickness "x" of the gasket after the bending process was made to fall within the range from 1.0 L to 1.85 L. Further, for comparison, gasket samples having the same shape as that of the above samples and an entire thickness of 1.8 L (2.25 mm) were produced using a sheet material made of Fe with the average thickness of 0.25 mm. When the evaluation test was conducted by the same method as the second embodiment, as shown in FIG. 8, it was confirmed that the gasket having the greatest number of overlapping layers of 5 had the same tendency as that having the overlapping layers of 4 which was evaluated in the second embodiment. In order for the gasket made of stainless steel to obtain the axial force equivalent to that acting on the conventional gasket made of Fe, it was determined that the entire thickness "x" should be 1.45 L or less.

Fifth Embodiment

Figure 9:
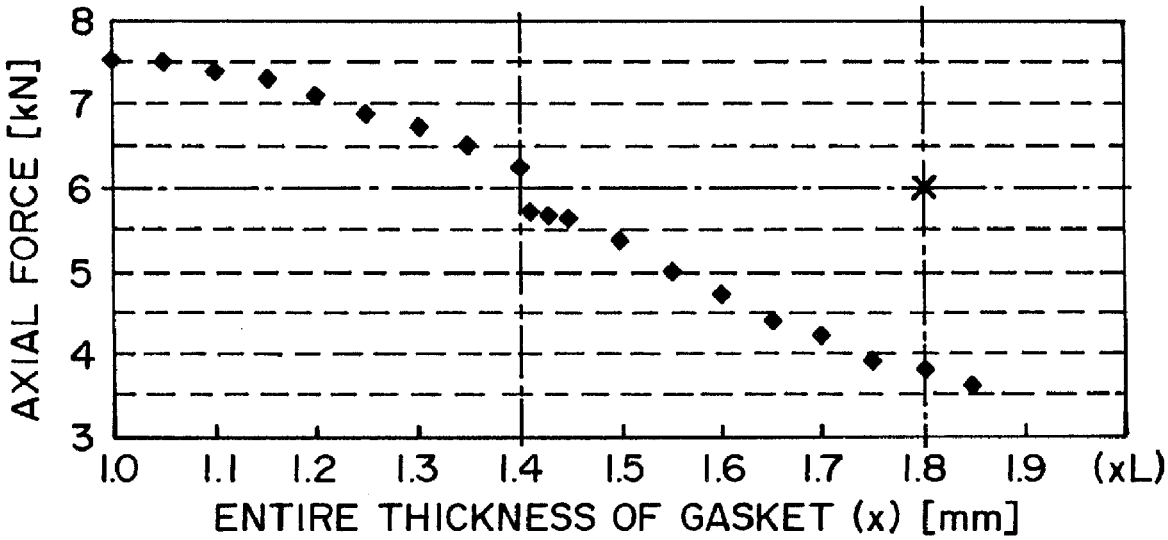
FIG. 9 is a graph showing a relation between the entire thickness of the gasket and axial force.

Similarly, an evaluation test for confirming an upper limit of the entire thickness "x" of the gasket for a spark plug that has a nominal diameter of M10 was conducted. In this evaluation test, a plurality of gasket samples made of stainless steel and satisfying the following conditions was prepared for an M10 spark plug. The average thickness "l" of the sheet material constituting the gasket was 0.3 mm, and the number of layers "n" of the sheet material was 4 in the region having the greatest number of overlapping layers in the axial "O" direction. The entire thickness "x" of the gasket after the bending process was made to fall within the range from 1.0 L to 1.85 L. Further, for comparison, gasket samples having the same shape as that of the above samples and an entire thickness of 1.8 L (2.16 mm) were produced using a sheet material made of Fe with the average thickness of 0.3 mm. Similar to the second embodiment, each sample was mounted on the aluminum bushing with the tightening torque of 12.5 N·m to thereby conduct an evaluation on the axial force acting on each sample. The result of the evaluation test is shown in FIG. 9. As the entire thickness "x" of the gasket for M10 increased, there was a tendency that the axial force acting on the gasket became small. In order for the gasket for M10 made of stainless steel to obtain the axial force equivalent to that acting on the conventional gasket made of Fe, it was determined that the entire thickness "x" should be 1.4 L or less.

Sixth Embodiment

Figure 10:
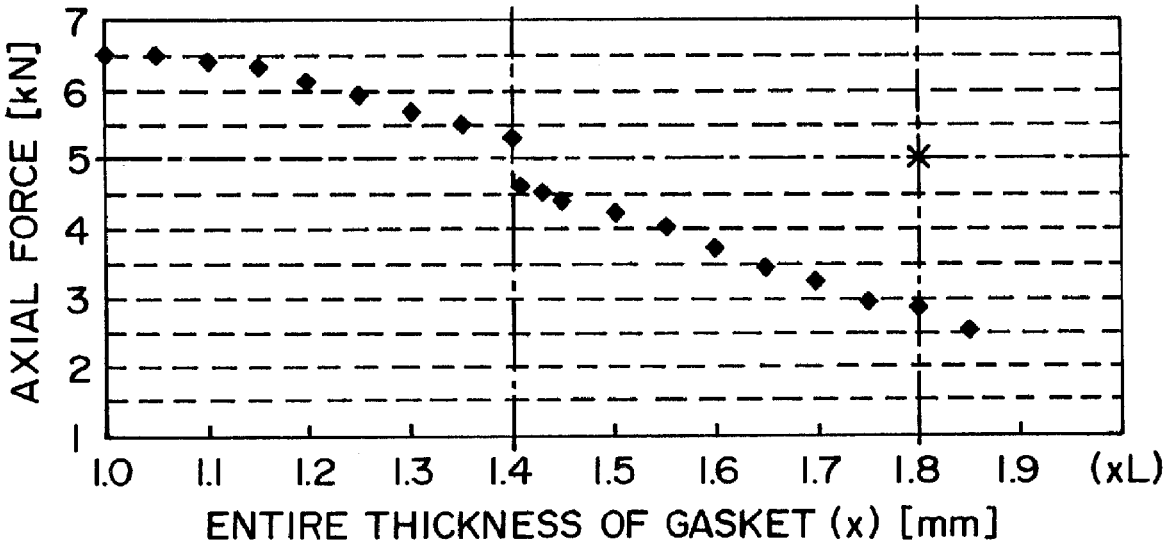
FIG. 10 is a graph showing a relation between the entire thickness of the gasket and axial force.

Similarly, an evaluation test was conducted on a gasket for a spark plug that has a nominal diameter of M8. In this evaluation test, a plurality of gasket samples made of stainless steel and satisfying the following conditions was prepared for an M8 spark plug. The average thickness "l" of the sheet material constituting the gasket was 0.4 mm, and the number of layers "n" of the sheet material was 3 in the region having the greatest number of overlapping layers in the axial "O" direction. The entire thickness "x" of the gasket after the bending process was made to fall within the range from 1.0 L to 1.85 L. Further, for comparison, gasket samples having the same shape as that of the above samples and an entire thickness of 1.8 L (2.16 mm) were produced using a sheet material made of Fe with the average thickness of 0.4 mm. Similar to the second embodiment, each sample was mounted on the aluminum bushing with the tightening torque of 10 N·m to thereby conduct an evaluation on the axial force acting on each sample. The result of the evaluation test is shown in FIG. 10. As the entire thickness "x" of the gasket for M8 increased, there was a tendency that the axial force acting on the gasket became small. In order for the gasket for M8 made of stainless steel to obtain the axial force equivalent to that acting on the conventional gasket made of Fe, it was determined that the entire thickness "x" should be 1.4 L or less.

Seventh Embodiment

Next, an evaluation test for specifying a size of the largest minimum radius of curvature R1 of the bent portion was conducted. As mentioned above, when the gasket is deformed with compressive force, the size of the minimum radius of curvature R1 of the bent portion which has the largest minimum radius of curvature R1 greatly influences a magnitude of deformation of the entire gasket, and further, influences the axial force acting on the gasket. As shown with the one-dot line in the graph in FIG. 4, the gasket satisfying the formula (1) hardly exhibits a buckling range whereas the axial force remains unchanged as the tightening torque rises. FIG. 4 also exhibits that the tightening torque and the axial force are mostly proportional. Thus, according to the relation between the rotation angle when mounting the spark plug to the mounting hole and the axial force acting on the gasket, an evaluation test on a size of the largest minimum radius of curvature R1 was conducted.

In this evaluation test, a plurality of gasket samples made of stainless steel and satisfying the following conditions was prepared for an M12 spark plug. The average thickness "l" of the sheet material constituting the gasket was 0.3 mm, and the number of layers "n" of the sheet material was 4 in the region having the greatest number of overlapping layers in the axial "O" direction. The minimum radius of curvature R1 falls within the range from 0.1 mm to 11.0 mm, and the entire thickness "x" of the gasket after the bending process was 1.33 L (1.6 mm). Each sample was provided on a spark plug for an evaluation test. The spark plugs were mounted on the aluminum bushings with the rotation angle ranging from 30 to 360 degrees in each kind of gasket. Then, the axial force acting on the gasket is measured by the same method as the second embodiment. The result of the evaluation test is shown with a graph in FIG. 11.

Figure 11:
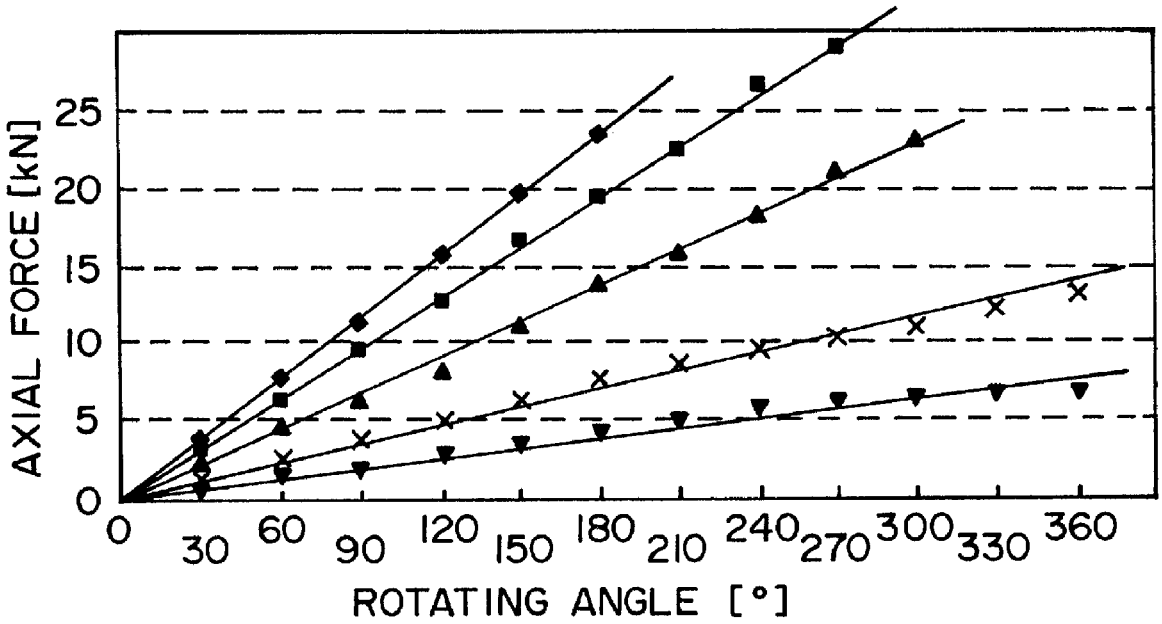
FIG. 11 is a graph showing a relation between a rotation angle caused by a difference in the minimum radius of curvature R1 and axial force.
Figure 12:
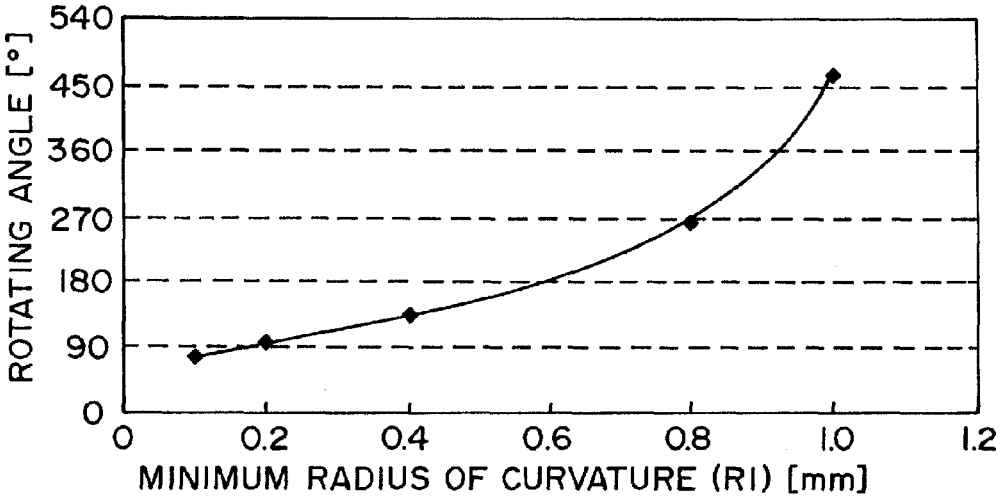
FIG. 12 is a graph showing a relation between the minimum radius of curvature R1 that can obtain axial force of 10 kN and the rotation angle.

As shown in FIG. 11, according to the result of the evaluation test, although a coefficient varies depending on the size of the minimum radius of curvature R1, it was determined that there was a proportional relation between the rotation angle and the axial force. Since the necessary axial force to prevent the loosening of the spark plug due to the vibration of an engine or the like is 10 kN, the rotation angle when the axial force of 10 kN is obtained can be inferred from a proportion line (shown with a solid line) in FIG. 11. The relation between the rotation angle and the minimum radius of curvature R1 is shown with a graph in FIG. 12. Generally, the range from 90 to 270 degrees (¼-¾ rotation), which is intuitively recognizable degrees, is adopted as a rotation angle at the time of tightening a spark plug. Based on the graph in FIG. 12, the value of the minimum radius of curvature R1 that falls within the range from the rotation angle of 90 to 270 degrees was calculated. Then, it was determined that the preferable minimum radius of curvature R1 was from 0.2 mm to 0.8 mm.

Eighth Embodiment

Next, an evaluation test for specifying the size of the smallest minimum radius of curvature R2 of the bent portion was conducted. As mentioned above, the smoothness of elastic deformation and plastic deformation of the bent portion which has the minimum radius of curvature R2 affects the adhesion when the sheet material constituting the gasket is attached firmly together. Thus, a plurality of gasket samples made of stainless steel and satisfying the following conditions was prepared for an M12 spark plug. The average thickness "l" of the sheet material constituting the gasket was 0.3 mm, and the number of layers "n" of the sheet material was 4 in the region having the greatest number of overlapping layers in the axial "O" direction. The minimum radius of curvature R2 was made to fall within the range from 0.03 mm to 0.25 mm, and the entire thickness "x" of the gasket after the bending process was 1.33 L (1.6 mm). Since a crack in the bending portion was observed in the samples having the minimum radius of curvature R2 of 0.03 mm, they were marked as X showing no formability. They were excluded from the evaluation test.

Each sample was provided on a spark plug, respectively, for the test, and these spark plugs were mounted on the aluminum bushing with the tightening torque of 20 N·m to thereby conduct a vibration test according to ISO 11565. More particularly, while heating the aluminum bushing at 200 degrees where the spark plug was mounted, the vibration with acceleration of 30 G±2 G, frequency of 50-500 Hz and sweep rate of 1 octave/min was applied for 8 hours to the spark plug in the axial direction and in a perpendicular direction to the axial direction. After the vibration test, a magnitude of torque (counter torque) required for removing the metal shell was measured. When the counter torque was 10 N m or more (50% or more at the time of tightening), it was marked as ○ showing a good tolerance over the loosening. On the other hand, when the counter torque was less than 10 N·m, it was marked as X showing a low tolerance over the loosening. The result of this evaluation test is shown in Table 1.

TABLE 1

| Minimum Radius of Curvature (R2) [mm] | Formability | Loosening Tolerance |
|---|---|---|
| 0.03 | X (Crack observed) | — |
| 0.05 | ○ | ○ |
| 0.10 | ○ | ○ |
| 0.20 | ○ | ○ |
| 0.25 | ○ | X |

As shown in TABLE 1, the gasket having the minimum radius of curvature R2 of 0.05 mm to 0.20 mm exhibited a good loosening tolerance. However, the gasket having the minimum radius of curvature R2 of 0.25 mm exhibited a problem in the loosening tolerance. It was determined from the result of this test that the minimum radius of curvature R2 of 0.05 mm to 0.20 mm was effective.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof. For example, in the state of the annular sheet material before bending process, the gasket 80 may be a sheet material having a slope in its thickness or may be a material with a uniform thickness. Although the gasket 80 having the region where the greatest number of overlapping layers "n" is 4 was described in the above, the number of layers may fall within the range from 2 to 5. In the embodiment, the gasket 80 provided on the spark plug 100 which had the nominal diameter of M12 was described. However, the same applies to a gasket provided on a spark plug which has the nominal diameter of M10 or M8.

The invention claimed is:

1. A sealing member for a cylindrical spark plug having a metal shell with threaded ridges thereon to be screwed into a mounting hole of a combustion engine, said sealing member comprised of a piece of annular sheet material made of austenitic stainless steel or ferritic stainless steel that is folded back in a radial direction so as to form a region where at least two or more layers of the sheet material are overlapped in an axial direction, the sealing member dimensioned to be disposed around an outer circumference of said metal shell of the cylindrical spark plug, wherein the sealing member is dimensioned to be compressed in the axial direction between an annular-shaped projecting portion disposed on and projecting outwardly from the outer circumference of the metal shell and an opening circumference edge portion of a mounting hole of a combustion engine to thereby provide a seal between the projecting portion and the opening circumference edge portion when the metal shell is screwed into the mounting hole of a combustion engine, wherein the sealing member is provided around the metal shell having a nominal diameter of M12, wherein, before being mounted on the combustion engine, the sealing member satisfies the following relations:

$$0.2 <= l[\text{mm}] <= 0.5;$$

$$2 <= n <= 5; \text{ and}$$

$$1.1\ L <= x <= 1.45\ L \quad (1),$$

where the number of layers of the sheet material that constitutes the sealing member is expressed by "n" in a region having the greatest number of overlapping layers in the axial direction, where an average thickness of the sheet material is expressed by "l" [mm], where a total thickness of each layer of the sheet material in the region in which the greatest number of overlapping layers is provided is expressed by "L" [mm], and where a thickness of the sealing member in the axial direction before being compressed is expressed by "x" [mm].

2. A sealing member for a cylindrical spark plug having a metal shell with threaded ridges thereon to be screwed into a mounting hole of a combustion engine, said sealing member comprised of a piece of annular sheet material made of austenitic stainless steel or ferritic stainless steel that is folded back in a radial direction so as to form a region where at least two or more layers of the sheet material are overlapped in an axial direction, the sealing member dimensioned to be disposed around an outer circumference of said metal shell of the cylindrical spark plug, wherein the sealing member is dimensioned to be compressed in the axial direction between an annular-shaped projecting portion disposed on and projecting outwardly from the outer circumference of the metal shell and an opening circumference edge portion of a mounting hole of a combustion engine to thereby provide a seal between the projecting portion and the opening circumference edge portion when the metal shell is screwed into the mounting hole of a combustion engine, wherein the sealing member is provided around the metal shell having a nominal diameter of M10, wherein, before being mounted on the combustion engine, the sealing member satisfies the following relations:

$$0.2 <= l[\text{mm}] <= 0.5;$$

$$2 <= n <= 5; \text{ and}$$

$$1.1\ L <= x <= 1.4\ L \quad (2),$$

where a number of layers of the sheet material that constitutes the sealing member is expressed by "n" in a region having the greatest number of overlapping layers in the axial direction, where an average thickness of the sheet material is expressed by "l" [mm], where a total thickness of each layer of the sheet material in the region in which the greatest number of overlapping layers is provided is expressed by "L" [mm], and where a thickness of the sealing member in the axial direction before being compressed is expressed by "x" [mm].

3. A sealing member for the spark plug according to claims 1 or 2, wherein a bent portion serves as a portion connecting a pair of overlapping portions of the sheet material in the axial direction by folding back on itself, wherein, in one of plurality of bent portions, a radius of curvature of a smallest portion is expressed by a minimum radius of curvature "R" in the bent portion, and wherein the sealing member satisfies the following relations:

$$0.2 <= R1 <= 0.8 \quad (3);$$

$$0.05 <= R2 <= 0.2 \quad (4); \text{ and}$$

$$R1 > R2 \quad (5),$$

where the minimum radius of curvature "R" of a first bent portion having a largest minimum radius of curvature is expressed by a minimum radius of curvature R1 [mm], and where the minimum radius of curvature "R" of a second bent portion having a smallest minimum radius of curvature is expressed by a minimum radius of curvature R2 [mm], when comparing all the minimum radii of curvature "R" of the plurality of bent portions.

4. A sealing member for the spark plug according to claim 3, wherein the sealing member satisfies the following relation:

$$t2 < t1 \quad (6)$$

where a thickness of the sheet material in a region having the minimum radius of curvature R1 of the first bent portion is expressed by t1 [mm], and where a thickness of the sheet material in a region having the minimum radius of curvature R2 of the second bent portion is expressed by t2 [mm].

5. A spark plug, comprising a sealing member according to claim 1.

* * * * *